US007648944B2

(12) United States Patent
Matsuo et al.

(10) Patent No.: US 7,648,944 B2
(45) Date of Patent: Jan. 19, 2010

(54) TRANSFER METHOD AND TRANSFER APPARATUS

(75) Inventors: Keisuke Matsuo, Kanagawa (JP); Eisuke Matsuda, Kanagawa (JP)

(73) Assignee: Sony Corporation, Tokyo (JP)

( * ) Notice: Subject to any disclaimer, the term of this patent is extended or adjusted under 35 U.S.C. 154(b) by 477 days.

(21) Appl. No.: 11/380,280

(22) Filed: Apr. 26, 2006

(65) Prior Publication Data

US 2006/0243377 A1 Nov. 2, 2006

(30) Foreign Application Priority Data

Apr. 27, 2005 (JP) ..... P2005-128908
Jun. 8, 2005 (JP) ..... P2005-168018

(51) Int. Cl.
*B41M 5/035* (2006.01)
*B41M 5/50* (2006.01)

(52) U.S. Cl. ..... 503/227; 264/78; 264/101

(58) Field of Classification Search ..... None
See application file for complete search history.

(56) References Cited

U.S. PATENT DOCUMENTS 5,342,817 A * 8/1994 Sarraf ..... 503/227
5,633,113 A * 5/1997 Ellis ..... 430/201
6,695,040 B1 2/2004 Phillips et al.
2004/0191564 A1 9/2004 Kim et al.

FOREIGN PATENT DOCUMENTS

JP 2004-79540 3/2004
JP 2004-200170 7/2004

* cited by examiner

*Primary Examiner*—Bruce H Hess
(74) *Attorney, Agent, or Firm*—Sonnenschein Nath & Rosenthal LLP

(57) ABSTRACT

A transfer method includes the steps of placing a donor substrate including a support base and a transfer layer provided on the support base onto a receptor substrate such that the transfer layer faces the receptor substrate, evacuating a space between the receptor substrate and the donor substrate that are placed one on the other, and transferring the transfer layer onto the receptor substrate by applying a radiant ray onto the donor substrate in an evacuated atmosphere.

8 Claims, 6 Drawing Sheets

TRANSFER METHOD AND TRANSFER APPARATUS

CROSS REFERENCES TO RELATED APPLICATIONS

The present invention contains subject matter related to Japanese Patent Application JP 2005-128908 filed in the Japanese Patent Office on Apr. 27, 2005 and Japanese Patent Application JP 2005-168018 filed in the Japanese Patent Office on Jun. 8, 2005, the entire contents of which are incorporated herein by reference.

BACKGROUND OF THE INVENTION

1. Field of the Invention

The present invention relates to a transfer method and a transfer apparatus used in the method, and more particularly, to a transfer method and a transfer apparatus for thermally transferring a luminescent layer of an organic electroluminescence (EL) device.

2. Description of the Related Art

In a full-color display device, organic electroluminescent devices corresponding to colors of R (red), G (green), and B (blue) are arranged on a substrate. In this display device, it is necessary at least to pattern luminescent layers corresponding to the colors in each organic electroluminescent device.

One method for patterning luminescent layers is a transfer method using an energy source (heat source) (thermal transfer method). As a thermal transfer method, for example, Japanese Unexamined Patent Application Publication No. 2004-200170 discloses a contact method in which transfer is performed while a donor substrate and a receptor substrate are in tight contact with each other with a transfer layer therebetween, and Japanese Unexamined Patent Application Publication No. 2004-79540 discloses a separate method in which transfer is performed while a donor substrate and a receptor substrate are separate from each other.

A transfer apparatus used in the thermal transfer method generally includes a vacuum chamber in which transfer operation is performed, and a radiation source that applies a radiant ray so as to apply heat to a donor substrate placed in the vacuum chamber. For example, movable holding members are provided in the vacuum chamber to respectively hold and vertically move a donor substrate and a receptor substrate. The holding member for the donor substrate is disposed above the holding member for the receptor substrate in the vacuum chamber such that the donor substrate and the receptor substrate face each other.

An opening that is one size smaller than the donor substrate is provided at the top of the vacuum chamber, and an airtight seal is provided on the periphery of the opening and on an upper inner wall of the vacuum chamber. The donor substrate closes the opening with the airtight seal therebetween, thereby keeping the vacuum chamber airtight.

The radiation source is disposed above the vacuum chamber to apply heat to the donor substrate. For example, a laser light source is used as a heat source. The laser light source is moved by an XY scanner so that a spot of laser light is scanned.

In order to form a luminescent layer of an organic electroluminescent device in a contact thermal transfer method using the above-described transfer apparatus, a receptor substrate and a donor substrate are put in the vacuum chamber, and are respectively mounted on the corresponding holding members so that an organic layer of the receptor substrate faces a transfer layer of the donor substrate.

Subsequently, the vacuum chamber is closed by blocking the top opening thereof by means of a gate valve from the outside, and the pressure in the vacuum chamber is reduced to that of a vacuum. Then, the holding member for the donor substrate is moved upward so that the donor substrate closes the opening from the inside, and the holding member for the receptor substrate is pushed up to bring the receptor substrate into contact with the donor substrate. When the gate valve is then opened, the upper portion of the vacuum chamber including the donor substrate is pushed from above by the atmospheric pressure, and therefore, the donor substrate is brought into tight contact with the receptor substrate. By scanning a spot of laser light over the donor substrate in this state, the transfer layer is transferred onto a predetermined region of the receptor substrate.

The basic configuration of a transfer apparatus that performs transfer in a separate thermal transfer method is the same as that of the above-described contact thermal transfer apparatus. A donor substrate and a receptor substrate are put in a vacuum chamber so as to face each other with some space therebetween. Then, the interior of the vacuum chamber is evacuated, and laser light is applied onto the donor substrate to transfer a transfer layer from the donor substrate onto the receptor substrate.

SUMMARY OF THE INVENTION

However, in the above-described contact transfer method, since the donor substrate and the receptor substrate are brought into contact after being placed to face each other in a evacuated atmosphere, movable holding members for moving the donor substrate and the receptor substrate need to be provided in the vacuum chamber. Further, since the holding members push up and hold the substrates against the atmospheric pressure, they are required to have sufficient strength to support the load. For this reason, the vacuum chamber has a complicated structure and a large size. Moreover, foreign substances may enter or the donor substrate may be damaged when the donor substrate and the receptor substrate are brought into tight contact with each other.

In the separate transfer method, movable holding members and a sufficient space are necessary to separately hold the donor substrate and the receptor substrate in the vacuum chamber. Therefore, the vacuum chamber also has a complicated structure and a large size.

Accordingly, a transfer method according to an embodiment of the present invention includes the steps of placing a donor substrate including a support base and a transfer layer provided on the support base onto a receptor substrate such that the transfer layer faces the receptor substrate; evacuating a space between the receptor substrate and the donor substrate; and transferring the transfer layer onto the receptor substrate by applying a radiant ray onto the donor substrate in an evacuated atmosphere.

In this transfer method, after the process for placing the donor substrate onto the receptor substrate, a space between the two substrates is evacuated. Therefore, the movable holding members for moving the donor substrate and the receptor substrate do not need to be disposed in the vacuum chamber used in this method.

A transfer apparatus according to another embodiment of the present invention transfers a transfer layer provided on a donor substrate onto a receptor substrate. The transfer apparatus includes a vacuum chamber that has a mount and that accommodates the receptor substrate and the donor substrate while the receptor substrate and the donor substrate are stacked on the mount; and a radiation source disposed above the vacuum chamber to apply a radiant ray onto the donor substrate. The vacuum chamber is configured to clamp the receptor substrate and the donor substrate by the mount and an upper portion of the vacuum chamber. The mount is fixed at a position such as to clamp the receptor substrate and the donor substrate.

In this transfer apparatus, the vacuum chamber is required to have only a space in which the receptor substrate and the donor substrate are stacked. Therefore, unlike the known contact transfer apparatus, it is unnecessary to provide movable holding members that are used to stack the receptor substrate and the donor substrate so as to face each other in the vacuum chamber. Moreover, it is also unnecessary to provide movable holding members and a space for separately holding the donor substrate and the receptor substrate. For this reason, the structure of the vacuum chamber is simplified, and the capacity thereof is reduced.

DESCRIPTION OF THE PREFERRED EMBODIMENTS

An embodiment of the present invention will be described in detail below with reference to the drawings.

Receptor Substrate

Figure 1A:
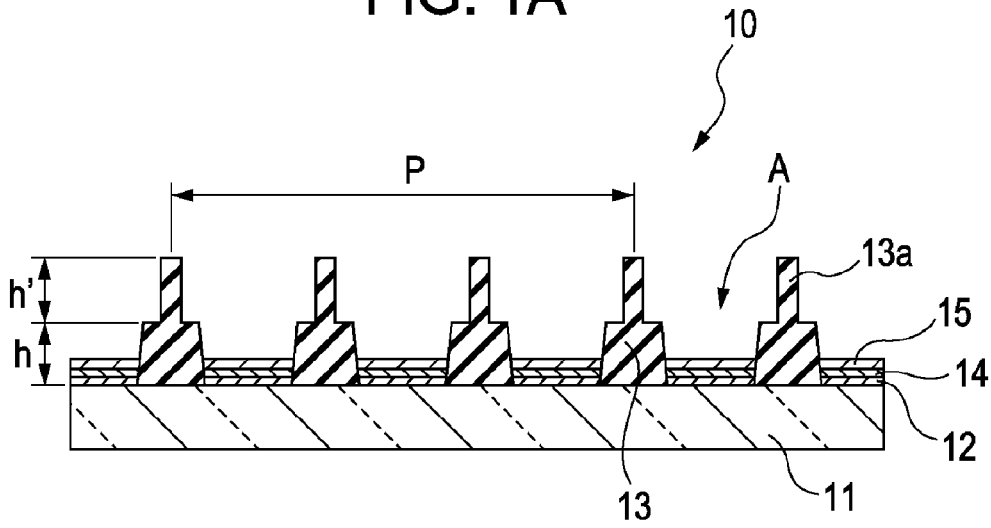
FIGS. 1A and 1B are a cross-sectional view and a plan view, respectively, schematically showing a receptor substrate used in a transfer method according to an embodiment of the present invention.
Figure 1B:
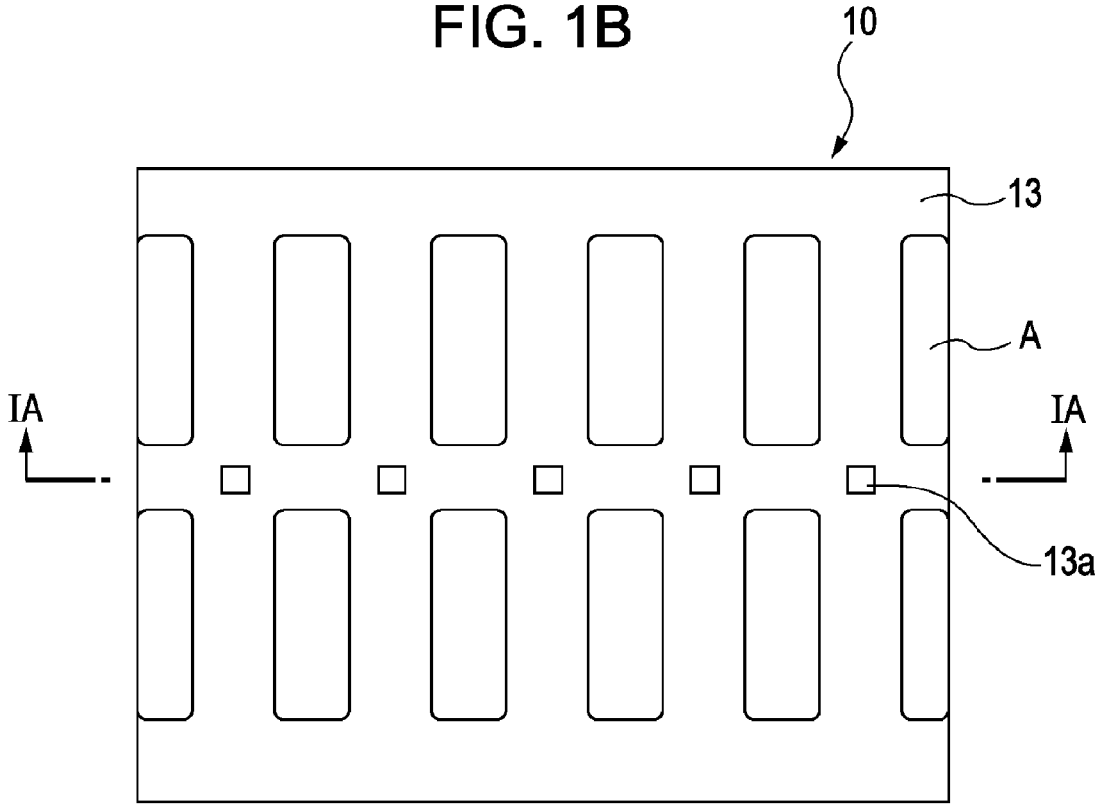

First, a receptor substrate will be described. FIGS. 1A and 1B are an enlarged cross-sectional view and an enlarged plan view, respectively, showing the principal part of a receptor substrate 10 used in an embodiment of the present invention. FIG. 1A is a cross-sectional view taken along line IA-IA in FIG. 1B.

As shown in FIG. 1A, TFTs (thin film transistors) (not shown) are formed on a base 11 made of, for example, glass, and a plurality of lower electrodes (positive electrodes) 12 made of, for example, chromium (Cr) are then patterned thereon corresponding to sub-pixels A while an interlayer insulating film is provided between the TFTs and the lower electrodes 12. Subsequently, for example, a polyimide film is formed to cover the lower electrodes 12, and an insulating layer 13, which is shaped like a lattice in plan view, is then formed by a first photolithographic process so as to separate the sub-pixels A. Consequently, the sub-pixels A, each shaped like a strip, are patterned at a pitch P of 300 μm/pixel.

Next, an upper surface of the insulating layer 13 is patterned by a second photolithographic process to form projections 13*a* shaped like a substantially rectangular parallelepiped. The projections 13*a* are formed on all intersections of the lattice-shaped insulating layer 13 over the entire pixel region where the sub-pixels A are arranged, as shown in FIG. 1B. In this case, the height h of the insulating layer 13 is 1 μm, and the height h' of the projections 13*a* is 2 μm.

The projections 13*a* function as spacers when a donor substrate is placed on the receptor substrate 10 in a transfer process that will be described below. When the donor substrate is placed on the receptor substrate 10, a space is formed by the projections 13*a* between the insulating layer 13 of the receptor substrate 10 and a luminescent layer of the donor substrate which will be described below. The space communicates with the outside of the substrates. For this reason, it is possible to evacuate the space between the substrates after the substrates are placed one on the other.

Further, since the projections 13*a* are provided between the receptor substrate 10 and the donor substrate, the luminescent layer of the donor substrate is prevented from being brought into tight contact with the sub-pixels A when the donor substrate is placed on the receptor substrate 10. This makes it possible to prevent the sub-pixels A from being damaged by the tight contact and to prevent foreign substances from entering from the donor substrate. Moreover, since the luminescent layer of the donor substrate touches only the projections 13*a*, it is reusable.

While the projections 13*a* are provided on all the intersections of the lattice-shaped insulating layer 13 in this embodiment, they do not always need to be provided on all the intersections or to be provided on the intersections as long as a space between the donor substrate and the receptor substrate 10 is evacated. Further, the projections 13*a* do not need to be provided in the pixel region. For example, the projections 13*a* may be arranged in a frame form on a portion of the insulating layer 13 outside the pixel region. However, it is preferable to equally space the projections 13*a* in the pixel region, because a uniform space is ensured between the receptor substrate 10 and the donor substrate over the entire pixel region, and a evacuated atmosphere is also reliably ensured between the substrates over the entire pixel region.

Subsequently, a hole injection layer 14 having a thickness of 25 nm and made of m-MTDATA [4,4,4-tris(3-methylphenylphenylamino)triphenylamine] is formed on the lower electrodes 12 commonly to all R, G, and B sub-pixels, for example, by evaporation. Then, a hole transport layer 15 having a thickness 30 nm and made of α-NPD [4,4-bis(N-1-naphthyl-N-phenylamino)biphenyl] is formed on the hole injection layer 14 commonly to all the R, G, and B sub-pixels, for example, by evaporation.

Alignment marks are formed at the corners of the base 11 such as to function as references for alignment with a laser emitting unit that will be described below.

Alignment Mark

An alignment mark is used to make an alignment correspondence between the donor substrate and the receptor substrate 10. When a plurality of alignment marks are used, a plurality of alignment correspondences can be made between the donor substrate and the receptor substrate 10.

Figure 5A:
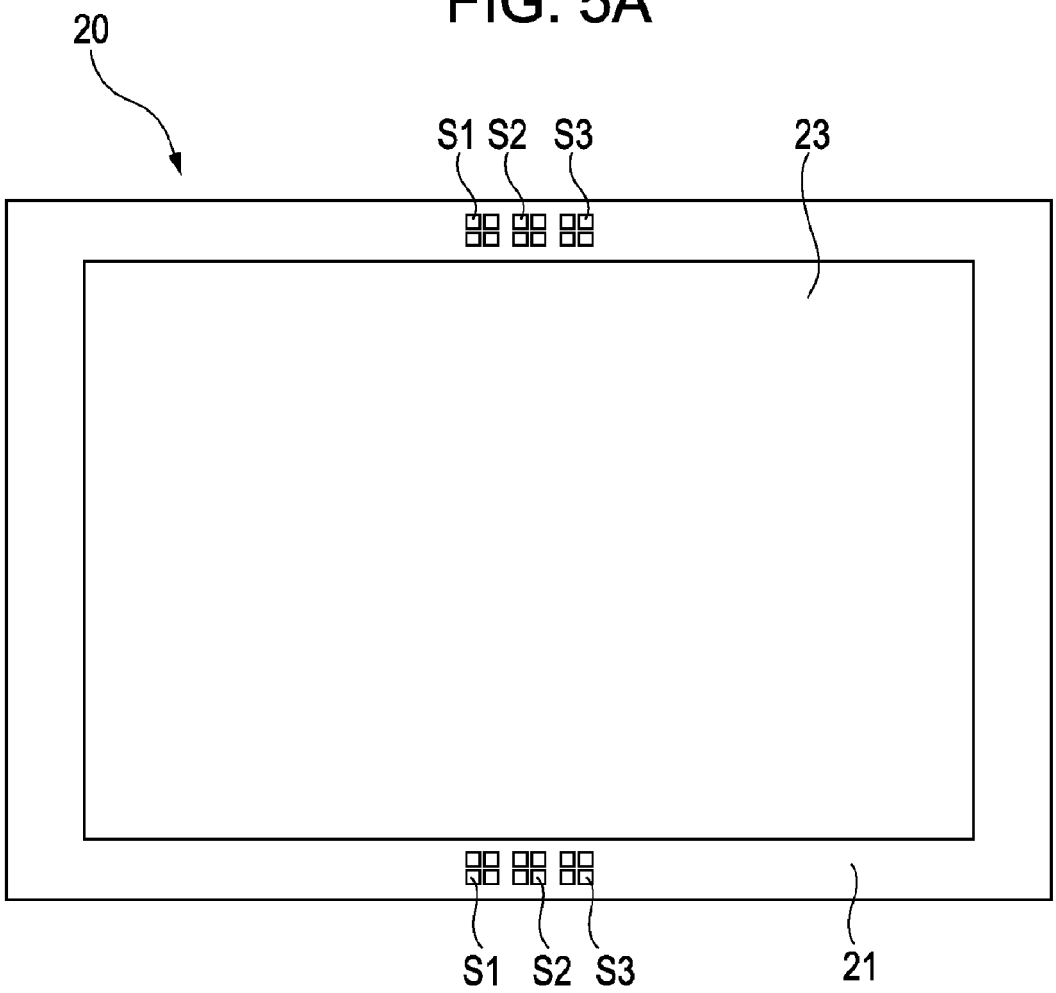
FIGS. 5A and 5B are schematic views of the donor substrate.
Figure 5B:
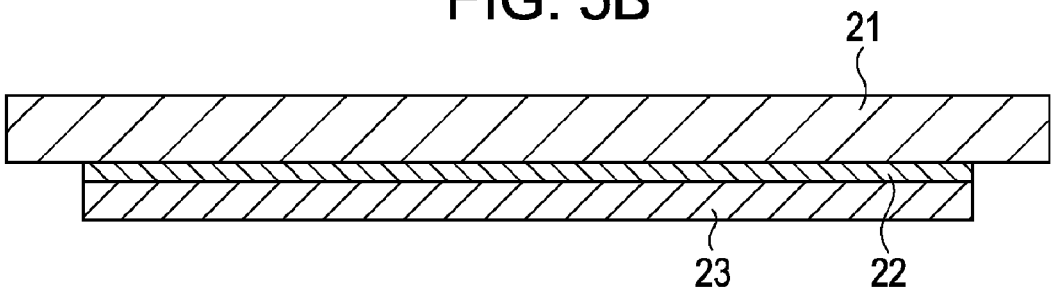

For example, when the transfer layer is transferred in three regions, three pairs of alignment marks are formed, as shown in FIG. 5A. Since a second transfer operation can be performed with a second pair of alignment marks that are different from a first pair of alignment marks used in a first transfer operation, a transfer material in a different region can be transferred onto a second receptor substrate even when the same donor substrate is used.

Figure 6A:
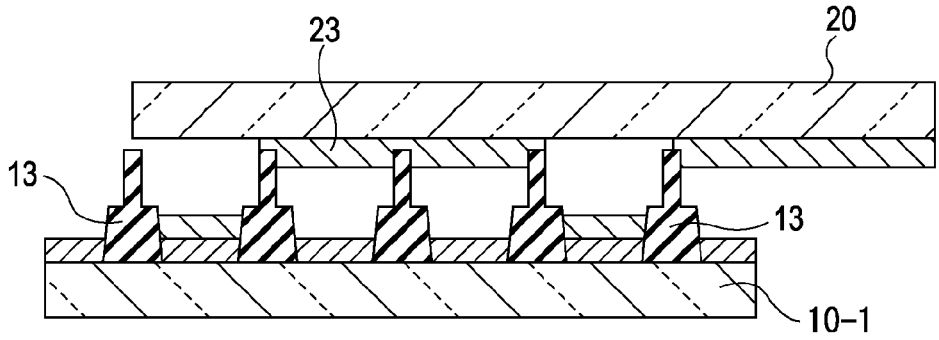
FIGS. 6A, 6B, and 6C are schematic views showing the transfer method using the donor substrate.
Figure 6B:
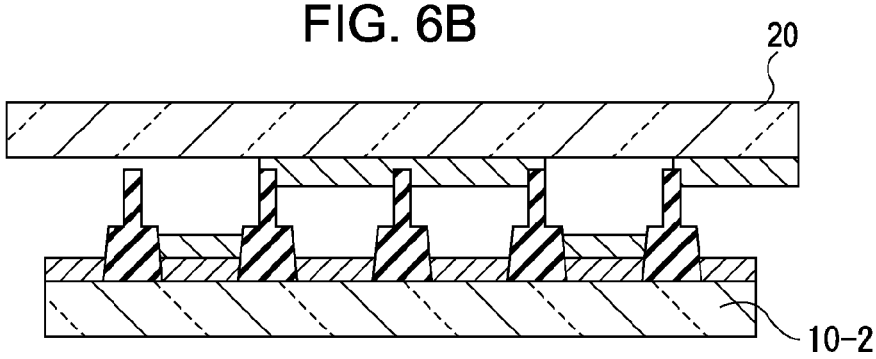
Figure 6C:
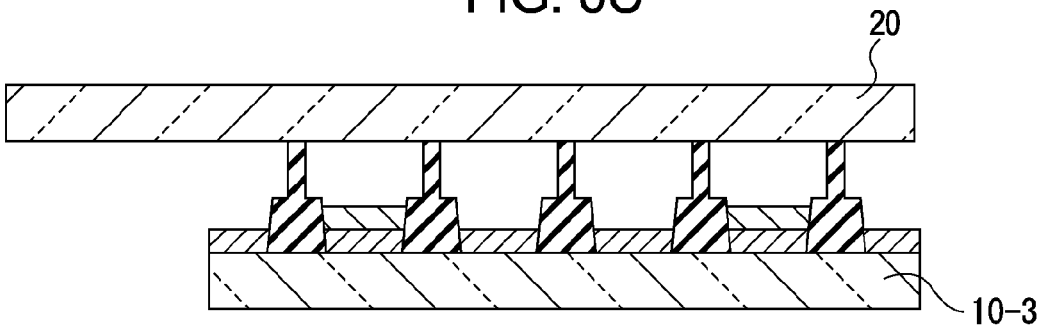

More specifically, when the donor substrate is divided in N-number of regions (N is an integer of two or more), a transfer layer in the first region of the N-number regions is transferred onto a first receptor substrate in a first transfer operation, and a transfer layer in the second region is transferred onto a second receptor substrate in a second transfer operation. Therefore, all transfer layers provided on one donor substrate can be transferred onto N-number of receptor substrates by N-number of transfer operations (see FIGS. 6A to 6C).

Receptor Substrate

Figure 2A:
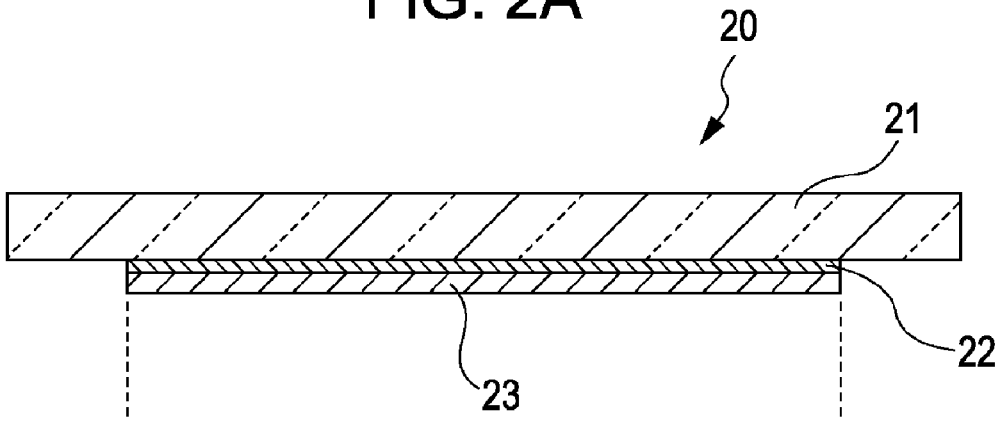
FIGS. 2A and 2B are a cross-sectional view and a plan view, respectively, schematically showing a donor substrate used in the transfer method.
Figure 2B:
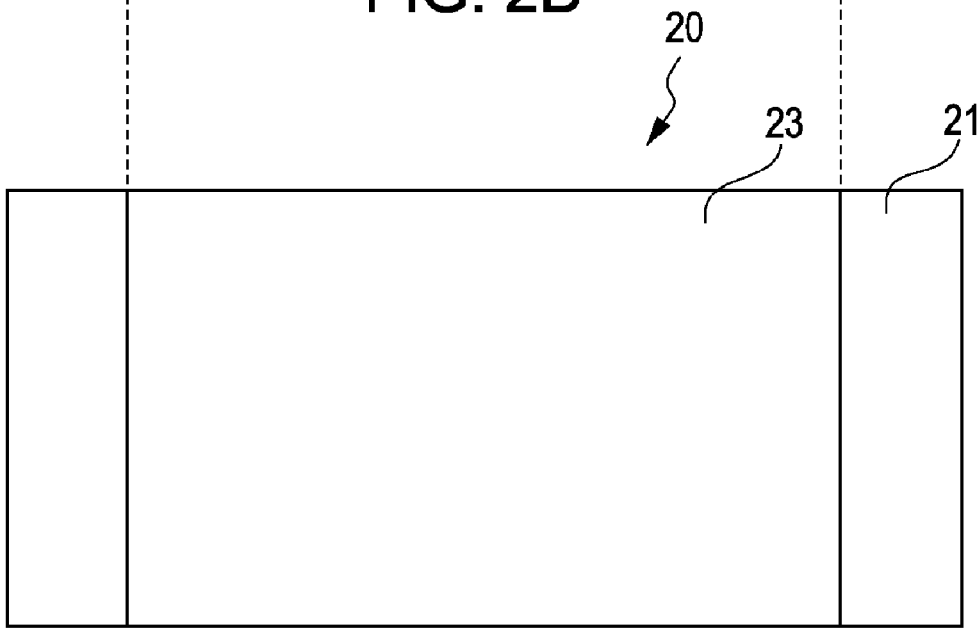

A donor substrate will now be described. FIGS. 2A and 2B are a cross-sectional view and a plan view, respectively, schematically showing a donor substrate 20 used in this embodiment.

A photothermal conversion layer (light absorbing layer) 22 made of, for example, chromium (Cr) and having a thickness of 200 nm is formed by sputtering on a glass support base 21 that has almost the same size as that of the receptor substrate 10. When laser light is applied to the donor substrate 20 in a transfer process that will be described below, the photothermal conversion layer 22 converts the laser light applied into heat.

A luminescent layer 23 having a thickness of, for example, 25 nm is formed on the photothermal conversion layer 22. In this embodiment, R, G, and B luminescent layers 23 are made of different organic compounds each having a light-emitting function in order to perform color display by causing a plurality of display sub-pixels R, G, and B arranged in a matrix on the above-described receptor substrate 10 to emit light. That is, at least three donor substrates 20 are prepared for one receptor substrate 10.

The red luminescent layer contains, for example, at least one of a red luminescent material and a charge transferring material. The red luminescent material may be fluorescent or phosphorescent. In this embodiment, the red luminescent layer has a thickness of approximately 30 nm, and is made of di(2-naphthyl)anthracene (ADN) containing 30% by weight of 2,6-bis[(4'-methoxydiphenylamino)styryl]-1,5-dicyanonaphthalene (BSN).

The green luminescent layer contains, for example, at least one of a green luminescent material and a charge transferring material. The green luminescent material may be fluorescent or phosphorescent. In this embodiment, the green luminescent layer has, for example, a thickness of approximately 30 nm, and is made of ADN containing 5% by weight of coumarin 6.

The blue luminescent layer contains, for example, at least one of a blue luminescent material and a charge transferring material. The blue luminescent material may be fluorescent or phosphorescent. In this embodiment, the blue luminescent layer has, for example, a thickness of approximately 30 nm, and is made ADN containing 2.5% by weight of 4,4'-bis[2-{4-(N,N-diphenylamino)phenyl}vinyl]biphenyl (DPAVBi).

The photothermal conversion layer 22 and the luminescent layer 23 are provided in an area such that they do not cover the alignment marks provided at the corners of the base 11 (FIG. 1A) when the donor substrate 20 is placed on the receptor substrate 10. Through the above-described procedure, the donor substrate 20 is produced. The support base 21 may be formed of a film.

Transfer Apparatus

Figure 3:
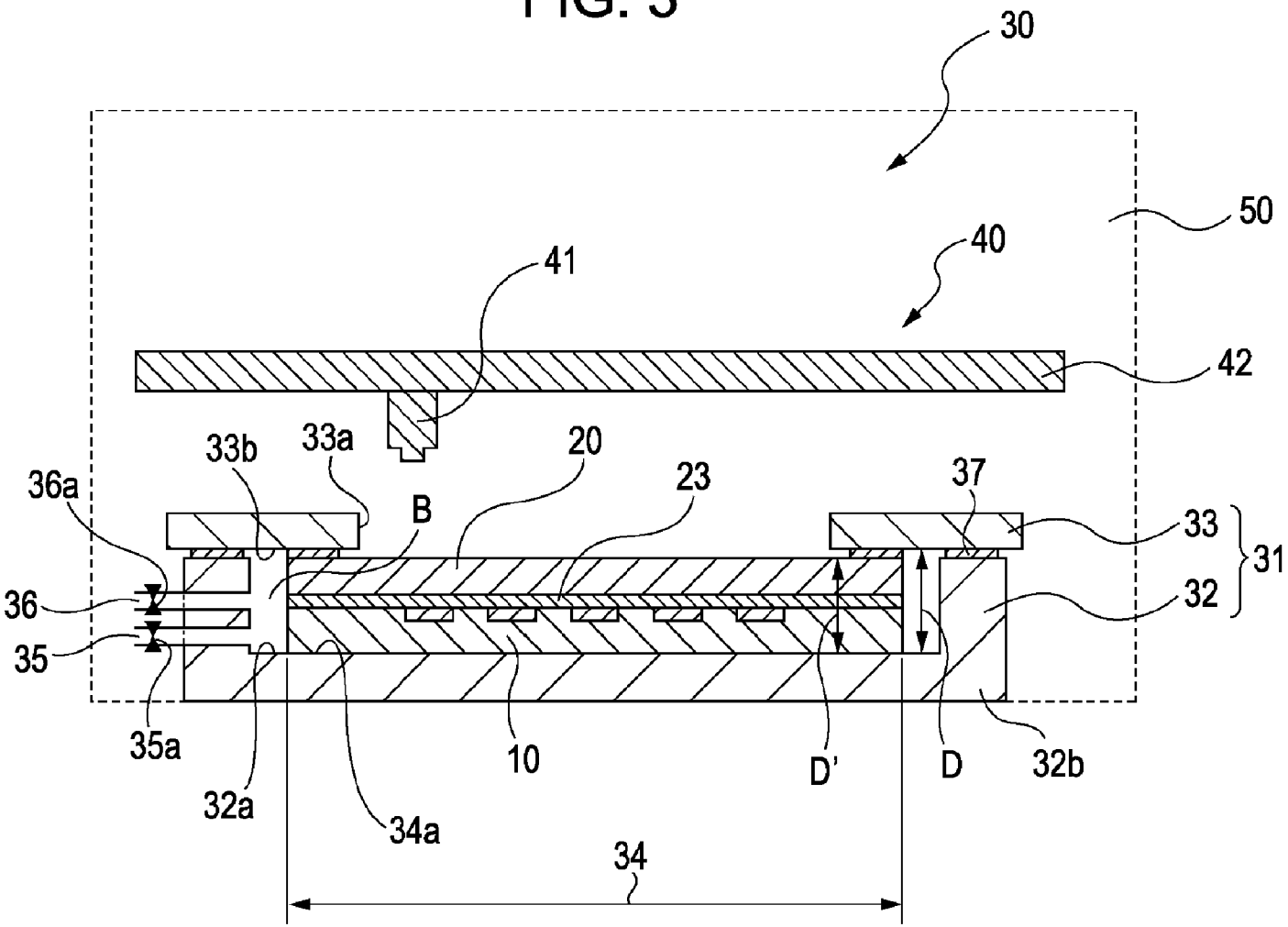
FIG. 3 is a cross-sectional view of a transfer apparatus in the embodiment.

A transfer apparatus 30 will now be described with reference to FIG. 3. As shown in FIG. 3, the transfer apparatus 30 includes a vacuum chamber 31 that can accommodate the receptor substrate 10 and the donor substrate 20 placed one on the other, and a laser emitting unit 40 that applies a radiant ray toward the donor substrate 20 accommodated in the vacuum chamber 31.

The vacuum chamber 31 includes a base 32 made of, for example, stainless steel and shaped like a container having an upper opening, and a frame-shaped cover 33 disposed on the base 32 and made of, for example, stainless steel.

The base 32 includes a mount 34 on which the receptor substrate 10 and the donor substrate 20 are stacked. The mount 34 is provided integrally with a bottom portion of the base 32. The base 32 has sufficient height to accommodate the receptor substrate 10 and the donor substrate 20 stacked on the mount 34.

A side wall 32*b* of the base 32 includes an exhaust opening 35 to which a vacuum pump (not shown) is connected to evacuate the vacuum chamber 31, and a leakage opening 36 from which the evacuated atmosphere in the vacuum chamber 31 is released. A valve 35*a* is provided at the exhaust opening 35, and a valve 36*a* is provided at the leakage opening 36.

Preferably, the side wall 32*b* is provided around the receptor substrate 10 and the donor substrate 20, which are stacked on the mount 34, with a space B therebetween. In this case, during a below-described transfer process, the space formed between the receptor substrate 10 and the donor substrate 20 by the projections 13*a* of the receptor substrate 10 can communicate with the space B. By evacuating the vacuum chamber 31, the space between the substrates can be reliably evacuated via the space B. However, it is preferable that the space B be small because the capacity of the vacuum chamber 31 can be reduced.

The frame-shaped cover 33 covers the base 32, and forms an upper portion of the vacuum chamber 31. An opening 33*a* that defines the frame of the cover 33 is one size smaller than the donor substrate 20. Airtight seals 37 are provided on a surface (inner wall) 33*b* of the cover 33 facing the base 32, that is, on an outer periphery of the surface 33*b* and around the opening 33*a*.

In the vacuum chamber 31, the base 32 and the cover 33 are connected, for example, at one side of the cover 33. The base 32 and the cover 33 are opened by lifting the other side of the cover 33, and are closed and locked by lowering the cover 33. While the base 32 and the cover 33 are connected at one side of the cover 33 in this embodiment, the cover 33 may be slidable on the base 32, and does not always need to be connected to the base 32.

In the vacuum chamber 31, the receptor substrate 10 and the donor substrate 20 stacked on the mount 34 are clamped by the mount 34 and the cover 33. That is, when the cover 33 is placed on the donor substrate 20, which is disposed on the mount 34 with the receptor substrate 10 therebetween, and on the base 32 with the airtight seals 37 disposed therebetween, the opening 33*a* is closed by the donor substrate 20, and the donor substrate 20, the cover 33, and the base 32 form an airtight space. When the vacuum chamber 31 is evacuated in this state, the cover 33 is pulled toward the inside of the vacuum chamber 31, and the donor substrate 20 and the cover 33 are pushed by the atmospheric pressure from above. Consequently, the receptor substrate 10 and the donor substrate 20 stacked on the mount 34 are clamped by the mount 34 and the cover 33.

The mount 34 is fixed at such a position as to clamp the receptor substrate 10 and the donor substrate 20. In this embodiment, the mount 34 is fixed by being formed integrally with the bottom portion of the base 32. In contrast to the known transfer apparatus, a movable holding member for holding the receptor substrate 10 in the vacuum chamber 31 is unnecessary, and the vacuum chamber 31 can sufficiently support the load applied by the atmospheric pressure. As a result, the structure of the vacuum chamber 31 is simplified.

A mounting surface 34*a* of the mount 34 is flush with a bottom surface 32*a* of the base 32. The distance D between the mounting surface 34*a* and the inner surface 33*b* of the cover 33 is substantially equal to the sum D' of thicknesses of the receptor substrate 10 and the donor substrate 20 placed one on the other. Since the height (distance D) that defines the capacity of the vacuum chamber 31 is the minimum height required to stack the receptor substrate 10 and the donor substrate 20, the capacity of the vacuum chamber 31 can be reduced, compared with the known transfer apparatus. In this case, however, since the airtight seals 37 are crushed by evacuating the vacuum chamber 31, the thickness of the airtight seals 37 is determined to be negligible.

The laser emitting unit 40 serving as a radiation source for emitting a radiant ray is disposed above the vacuum chamber 31. The laser emitting unit 40 includes a laser light source 41, and an XY scanner 42 that moves the laser light source 41 in the XY directions while the laser light source 41 is emitting a spot of laser light. An alignment camera is provided adjacent to the laser light source 41. The alignment camera can capture images of the alignment marks provided on the receptor substrate 10, and align the laser light source 41 and the receptor substrate 10.

The radiation source is not limited to the laser light source 41, and may be, for example, a heat bar or a thermal head. In this case, heat can be directly applied to the donor substrate 20, and therefore, the photothermal conversion layer 22 provided in the donor substrate 20 may be omitted.

For example, three transfer apparatuses 30 are provided in an outer chamber 50 to transfer color luminescent layers 23. Preferably, the outer chamber 50 is filled with inert gas. This prevents organic layers including the luminescent layers 23 from being damaged by exposure to water and oxygen in the air when the receptor substrate 10 is moved among the transfer apparatuses 30.

As a modification, the vacuum chamber 31 may include a plate-shaped base, and a box-shaped cover that covers and closes the base. Alternatively, the base and the cover may be integrally provided such that substrates can be inserted in the vacuum chamber 31 from a side wall. Further, a plurality of recesses may be provided at the bottom of the outer chamber 50 to accommodate the receptor substrate 10 and the donor substrate 20, and a plate-shaped cover may be provided to close the recesses.

Transfer Process

Figure 4A:
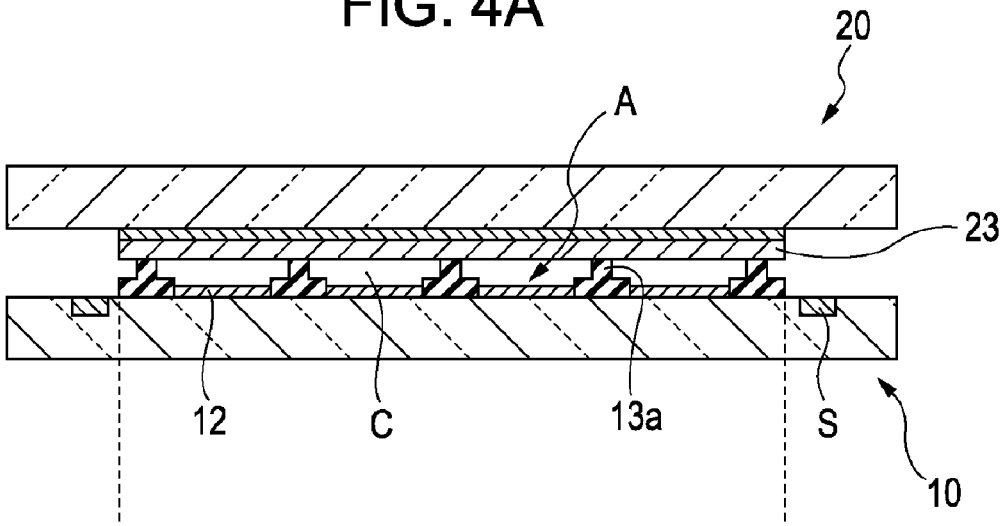
FIGS. 4A and 4B are a cross-sectional view and a top view, respectively, explaining the transfer method.

A transfer process will now be described. First, the receptor substrate 10 is placed on the mount 34 of the base 32 in a state in which the outer chamber 50 is filled with inert gas. In this case, a surface of the receptor substrate 10 having the lower electrodes 12 faces upward, as shown in FIG. 4A. Since the hole injection layer 14 and the hole transport layer 15 are stacked in that order on the lower electrodes 12, as shown in FIG. 1A, transfer is performed on the hole transport layer 15.

Figure 4B:
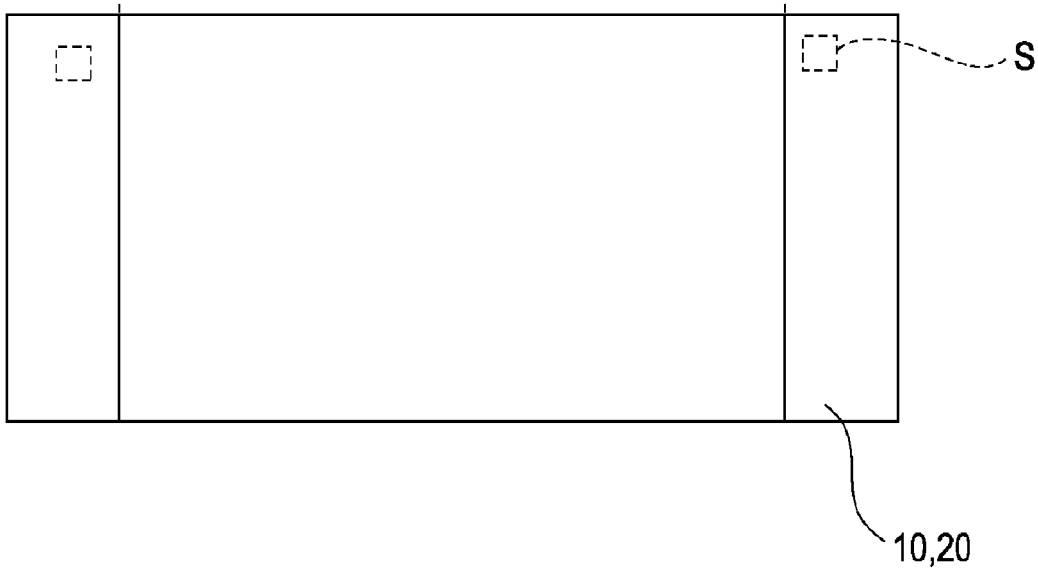

Then, the donor substrate 20 is placed on the receptor substrate 10 in a state in which a surface of the donor substrate 20 having the luminescent layer 23 faces the receptor substrate 10. The donor substrate 20 is supported by the projections 13*a*. Also, a space C that communicates with the outside is formed between the receptor substrate 10 and the donor substrate 20 by the projections 13*a*. In this case, the alignment marks S provided at the corners of the receptor substrate 10 are seen through the donor substrate 20, as shown in FIG. 4B serving as a top view.

The receptor substrate 10 and the donor substrate 20 may be placed on the mount 34 after being stacked in the outer chamber 50 filled with inert gas.

Subsequently, the frame-shaped cover 33 is placed and locked on the base 32 and the donor substrate 20 with the airtight seals 37 therebetween, as shown in FIG. 3. Since the opening 33*a* of the cover 33 is blocked by the donor substrate 20, the vacuum chamber 31 is closed.

After that, the valve 35*a* provided at the exhaust opening 35 is opened to reduce the pressure inside the vacuum chamber 31. In this case, the cover 33, which is disposed on the base 32 and the donor substrate 20 with the airtight seals 37 therebetween, is pulled into the vacuum chamber 31, and the vacuum chamber 31 is evacuated. Further, the cover 33 and the donor substrate 20 are pushed toward the receptor substrate 10 by the atmospheric pressure from above, and the donor substrate 20 on the receptor substrate 10 is clamped by the mount 34 and the cover 33 while being supported by the projections 13*a*.

In this state, the space B in the vacuum chamber 31 is placed in a vacuum, and the space C (see FIG. 4A), which is provided between the receptor substrate 10 and the donor substrate 20 so as to communicate with the space B, is also placed in a vacuum. In this case, the luminescent layer 23 provided in the donor substrate 20 touches only the projections 13*a*, and therefore, is prevented from damage. For this reason, the donor substrate 20 can also be used in the second and subsequent transfer operations. In addition, since tight contact between the donor substrate 20 and the receptor substrate 10 is prevented by the projections 13*a* provided therebetween, foreign substances will not enter the sub-pixels A (FIG. 4A) in the receptor substrate 10, and the sub-pixels A can also be prevented from being damaged by the donor substrate 20.

Next, images of the alignment marks S (FIG. 4A) on the receptor substrate 10 are captured by the alignment camera of the laser emitting unit 40, and the receptor substrate 10 and the laser light source 41 are thereby aligned. After that, for example, a spot of infrared laser light having a wavelength of 800 nm is emitted from the laser light source 41, and is absorbed by the photothermal conversion layer 22 of the donor substrate 20. A red luminescent layer 23 is selectively transferred onto the hole transport layer 15 of the receptor substrate 10 by using heat generated by the absorption. In this case, the width of the spot of the infrared laser light is set at 100 μm.

The laser light may be applied over the entire surface of the donor substrate 20 via a shielding mask that has openings corresponding to portions to which the laser light should be applied.

After the completion of the transfer operation, the valve 35*a* of the exhaust opening 35 is closed and the valve 36*a* of the leakage opening 36 is opened to increase the pressure in the vacuum chamber 31 to normal pressure. Subsequently, the cover 33 is opened, the donor substrate 20 is separated from the receptor substrate 10, and the receptor substrate 10 is moved to the blue and green transfer apparatuses 30 in the outer chamber 50 placed in a evacuated atmosphere. Then, a blue luminescent layer and a green luminescent layer are transferred in a similar process by using corresponding donor substrates 20.

After that, a process similar to a normal production process for an organic electroluminescent device is performed. That is, an electron transport layer is formed on the luminescent layers 23 all over the display area. The electron transport layer has a thickness of approximately 20 nm, and is made of 8-hydroxyquinoline aluminum (Alq3).

Subsequently, an electron injection layer made of lithium fluoride (LiF) and having a thickness of approximately 0.3 nm (deposition rate is 0.01 nm/sec) is formed by vacuum deposition, and a negative electrode made of magnesium silver (MgAg) and having a thickness of 10 nm is formed as an upper electrode by vacuum deposition. The negative electrode is formed as an upper common electrode.

An insulating or conductive protective film is formed on the upper common electrode. When the protective film is insulating, it is made of an inorganic amorphous insulating material such as amorphous silicon (α-Si), amorphous silicon carbide (α-SiC), amorphous silicon nitride (α-Sil-x Nx), or amorphous carbon (α-C).

When the protective film is conductive, it is made of, for example, ITO (indium tin oxide) or IZO (indium zinc oxide). As necessary, a glass substrate is fixed onto the protective film with ultraviolet curing resin therebetween. Through the above-described procedure, the production of a display device is completed.

While the luminescent layer 23 of the organic layers that constitute the organic electroluminescent device is formed by the thermal transfer method in the above-described embodiment, the present invention is applicable not only to the luminescent layer 23, but also to other organic layers such as the hole injection layer 14, the hole transport layer 15, and the electron transport layer.

While the production method for the upper-surface emitting display device having the organic electroluminescent device has been described in the above embodiment, the present invention is not limited thereto, and is also applicable to a lower-surface emitting (transmissive) display device. In this case, the lower electrodes 12 are made of a highly transparent conductive material such as ITO, and the upper electrode is made of a highly reflective conductive material.

While the lower electrode 12 are positive electrodes and the upper electrode is a negative electrode in the above-described embodiment, the present invention is also applicable to a display device in which the lower electrodes are negative electrodes and the upper electrode is a positive electrode.

It should be understood by those skilled in the art that various modifications, combinations, sub-combinations and alterations may occur depending on design requirements and other factors insofar as they are within the scope of the appended claims or the equivalents thereof.

What is claimed is:

1. A transfer apparatus which transfers a transfer layer provided on a donor substrate onto a receptor substrate, the transfer apparatus comprising:

a vacuum chamber having a base including a mount and sidewalls which together form a chamber and which accommodates within the chamber the receptor substrate and the donor substrate, and a cover which covers the base and which forms an upper portion of the vacuum chamber, the cover being a frame having an opening which is smaller than the donor substrate; and a radiation source disposed above the vacuum chamber and which can apply a radiant ray onto the donor substrate, wherein, the vacuum chamber is configured to clamp the receptor substrate and the donor substrate together by means of the mount and an upper portion of the vacuum chamber, the mount is fixed at a position where the receptor substrate and the donor substrate are stacked, the opening is closed by the donor substrate placed on the mount with the receptor substrate therebetween such that an airtight space is formed by the donor substrate, the cover and the base, the cover is spaced from the mount such that only the donor substrate and the receptor substrate are accommodated between the cover and the mount, and the radiation source can apply the radiant ray onto the donor substrate via the cover opening.

2. The transfer apparatus according to claim 1, wherein the mount has a mounting surface which is flush with a bottom face of the vacuum chamber, and the distance between the bottom face and an inner surface of the upper portion of the vacuum chamber is substantially equal to the sum of thicknesses of the donor substrate and the receptor substrate.

3. The transfer apparatus according to claim 1, wherein the base includes a side wall which extends around the receptor substrate and the donor substrate, accommodated on the mount, with a space therebetween.

4. The transfer apparatus according to claim 3, wherein the side wall includes an exhaust opening via which the vacuum chamber can be evacuated, and a leakage opening from which the evacuated atmosphere in the vacuum chamber can be released.

5. The transfer apparatus according to claim 1, wherein airtight seals are provided on a surface of the cover facing the base.

6. The transfer apparatus according to claim 1, wherein the receptor substrate has projections which support the donor substrate placed on the receptor substrate and which maintain a space between the donor substrate and the receptor substrate.

7. The transfer apparatus according to claim 1, wherein the transfer layer is a luminescent layer of an organic electroluminescent device.

8. The transfer apparatus according to any one of the claims 1 and 3 to 7 comprising an outer chamber which encloses the vacuum chamber and radiation source and which is filled with inert gas when the transfer layer is transferred.

* * * * *